United States Patent [19]

Shaw

[11] 4,179,248

[45] Dec. 18, 1979

[54] OIL EQUALIZATION SYSTEM FOR PARALLEL CONNECTED HERMETIC HELICAL SCREW COMPRESSOR UNITS

[75] Inventor: David N. Shaw, Unionville, Conn.

[73] Assignee: Dunham-Bush, Inc., West Hartford, Conn.

[21] Appl. No.: 930,444

[22] Filed: Aug. 2, 1978

[51] Int. Cl.[2] ..... F04B 23/04; F04B 39/02; F04B 17/00

[52] U.S. Cl. ..... 417/427; 417/428; 418/97; 62/510; 417/410

[58] Field of Search ..... 62/510; 417/302, 307, 417/426, 427, 428, 441; 418/97

[56] References Cited

U.S. PATENT DOCUMENTS

| | | | |
|---|---|---|---|
| 1,916,130 | 6/1933 | Torrey | 417/441 |
| 3,237,852 | 3/1966 | Shaw | 417/372 |
| 3,386,262 | 6/1968 | Hackbart et al. | 62/510 |
| 3,785,169 | 1/1974 | Gylland | 62/510 |
| 3,922,114 | 11/1975 | Hamilton | 418/97 |

*Primary Examiner*—William L. Freeh
*Attorney, Agent, or Firm*—Sughrue, Rothwell, Mion, Zinn and Macpeak

[57] ABSTRACT

A pair of helical screw rotary hermetic compressor units are connected in parallel across common suction and discharge manifolds. The discharge manifolds open to each unit casing well above the level of accumulated oil within the bottom of the hermetic casings acting as oil sumps. Oil bleed lines are provided for the casings which open to the casing interior at oil bleed ports at the normal level of accumulated oil. The bleed lines are of small diameter and open directly to the discharge manifold at points downstream of the connection between the discharge manifold and the hermetic casing. Excessive accumulation of oil within one of the hermetic compressor casings causes the oil to bleed through its bleed line under a small pressure differential to the discharge manifold for redistribution to the remaining compressors.

4 Claims, 1 Drawing Figure

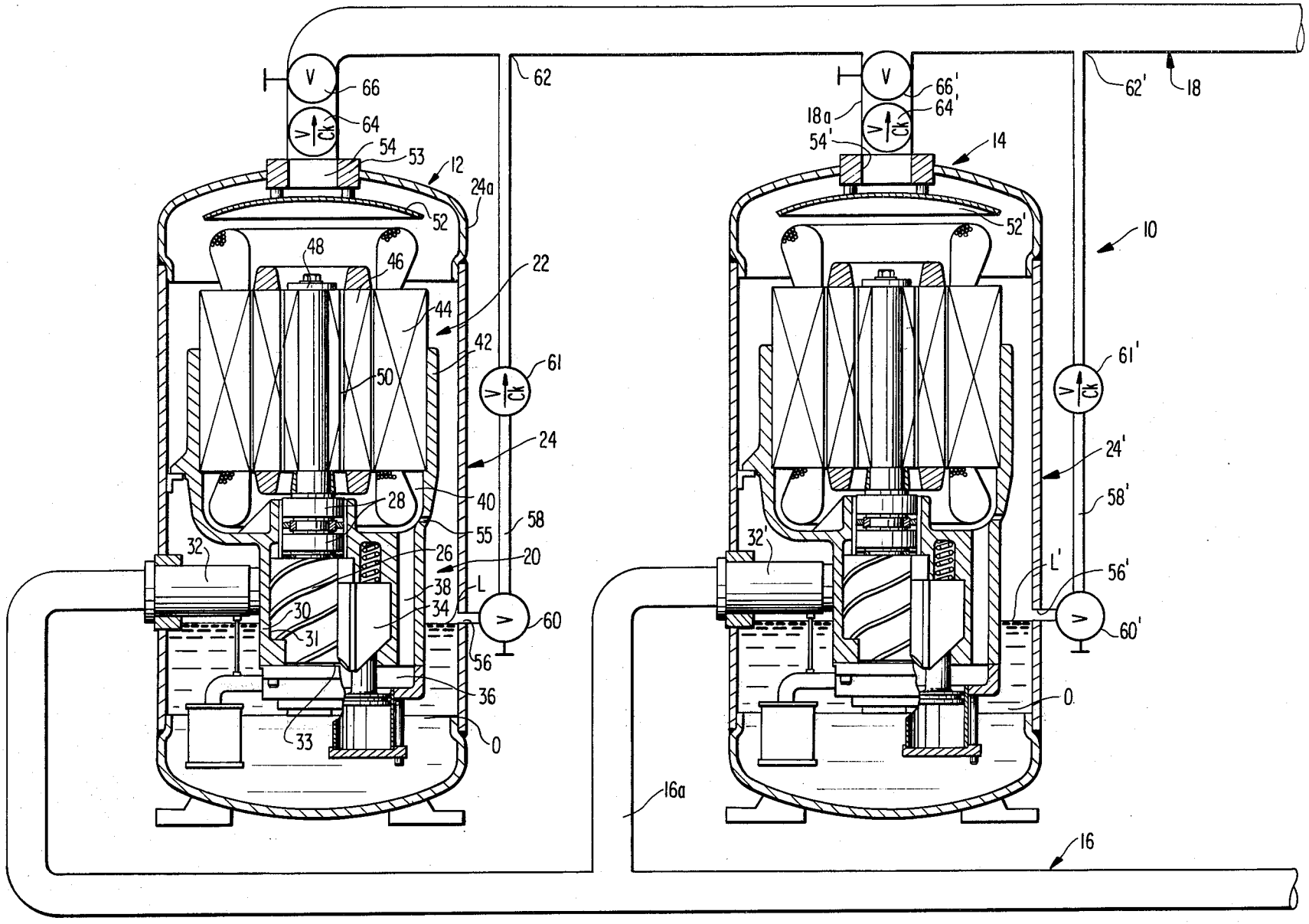
10
12
14
16
16a
18
18a
20
22
24
24a
24'
26
28
30
31
32
32'
33
34
36
38
40
42
44
46
48
50
52
52'
53
54
54'
55
56
56'
58
58'
60
60'
61
61'
62
62'
64
66
66'
L
L'
O

OIL EQUALIZATION SYSTEM FOR PARALLEL CONNECTED HERMETIC HELICAL SCREW COMPRESSOR UNITS

FIELD OF THE INVENTION

This invention relates to compressed gas distribution systems, and more particularly, to such systems employing multiple parallel helical screw hermetic rotary compressors.

BACKGROUND OF THE INVENTION

Where gas distribution systems employ compressors in parallel for compressing the gas and distributing the same through a discharge manifold and where a suction manifold extends from the end use device or devices and feeds the return gas to be compressed to the multiple, parallel compressors the gas is employed in the compressor for carrying oil for lubrication and other purposes. There is a tendency, depending upon the characteristics of the system distribution means and/or the compressors themselves for oil to excessively accumulate within one or more of the compressors, while others are simply starved of oil. Attempts have been made to provide bleed line connections between such compressors and utilize gas pressure differentials between the compressors to circulate oil to the starved compressor. Where the compressors constitute hermetic units, the bottom of the casing of the compressor acts as an oil sump for receiving accumulated oil and for supplying the oil to the moving parts of the compressor unit for both lubrication and sealing. Such oil distribution arrangement is the subject matter of applicant's earlier U.S. Pat. No. 3,237,852 as applied to a compressed gas distribution system employing multiple parallel hermetic motor compressor units of the reciprocating piston type.

Recently, there has been successful commercial exploitation of relatively small vertical axis helical screw rotary compressor hermetic units, wherein the helical screw compressor comprised of intermeshed rotary helical screws, being vertically oriented, are mounted for rotation about parallel, vertical axes within a hermetic compressor casing and with an electric drive motor for the helical screw rotors being vertically mounted above one of the helical screws, and with the rotor shaft for the electric motor constituting an extension of one of the helical screws. Further, in conjunction with an oil separation scheme, the interior of the hermetic casing is maintained at compressor discharge pressure with the major portion of the separated oil accumulating within the bottom of the casing and rising to a level less than the vertical height of the intermeshed helical screws and well below the level of the electric motor components. In the case of the helical screw rotary compressors, the oil is required not only for lubrication of the moving parts, but in addition performs an excellent seal between the intermeshed helical screws. Even though means are provided for extracting the oil from the compressed gas on the discharge side of the compressor such as centrifugal means as well as gas deflectors between the discharge port of the compressor below the electric drive motor and the casing discharge port, which is normally centrally located within the top wall or cover of the casing, some oil is carried away by the discharge gas. Due to the idiosyncrasies and individual characteristics of the machine and the distribution system, as mentioned previously, one or more of the parallel helical screw compressors will tend to accumulate an excess of oil, while the oil levels within the sump portion of the hermetic casing of another compressor will drop. This results in inadequate lubrication and sealing for those hermetic units having reduced oil supply, while the overaccumulation of oil in the unit or units tending to build up oil, may adversely affect proper operation of the helical screw compressor portion of those units.

It is therefore a primary object of the present invention to provide an improved oil equalization scheme for a rotary gas distribution system employing parallel, connected helical screw rotary compressor hermetic units in which overaccumulation of oil within the sump portion of the hermetic casing of any one of the units, automatically results in the bleed of accumulated oil from that unit for circulation within the gas distribution system and redistribution to the remaining compressor unit.

It is a further object of the present invention to provide an improved gas distribution system employing multiple, parallel helical screw rotary compressor hermetic units in which the compressor discharge pressure of a given unit is advantageously employed in effecting the redistribution of oil from the unit having an overaccumulation of oil to the other units in a simplified yet positive manner.

SUMMARY OF THE INVENTION

The present invention has application to a compressed gas distribution system employing at least a first and second hermetic, helical screw rotary compressor unit, each compressor unit including a hermetic casing defining a sump for accumulation of oil, and employing intermeshed helical rotary screws and having a compressor inlet and a compressor outlet. The gas distribution system comprises a suction manifold and a discharge manifold and means for connecting the suction manifold to the compressor inlet of respective compressors, with the compressor outlet opening to the interior of the compressor casing such that the lower portion of the casing defines a sump for accumulation of oil with the casing interior at compressor discharge pressure. The casing is provided with an outlet port well above the level of accumulated oil and opening to the discharge manifold. The improvement comprises an oil bleed port within each casing at the normal level of accumulated oil and a small diameter oil line connecting the oil bleed port to the suction manifold at a point downstream of the hermetic compressor casing outlet port connection to the discharge manifold; whereby, the compressor discharge pressure within the casing causes excessive oil accumulating within a given casing to flow through the small diameter oil line to the discharge manifold for redistribution to the remaining compressor or compressors to equalize the amount of oil within each compressor unit. Check valves are preferably located in the discharge manifold between each compressor and its oil line connection and within the oil line between the bleed port and the discharge manifold to insure discharge gas flow from the hermetic unit to the common discharge manifold and the prevention of discharge gas reverse flow through the oil line back to the compressor casings of respective units.

BRIEF DESCRIPTION OF THE DRAWINGS

The single FIGURE is a partial schematic, partial vertical sectional view of a portion of a compressed gas distribution system including parallel helical screw rotary compressor hermetic units employing the oil equalization system in a preferred embodiment of the present invention.

DESCRIPTION OF THE PREFERRED EMBODIMENT

Referring to the FIGURE the compressed gas distribution system indicated generally at 10 employs the compressor oil equalization scheme of the present invention and is shown as applied to a system involving a pair of helical screw rotary hermetic compressor units indicated generally at 12 and 14, respectively, and being connected in parallel to a suction manifold indicated generally at 16 and a discharge manifold indicated generally at 18. Taking hermetic compressor unit 12 as an example, this unit involves two sections: a lower helical screw compressor section indicated generally at 20 and an upper electric drive motor 22, the the compressor being vertically orientated and being mounted within hermetic casing 24. A pair of intermeshed helical screws or rotors are provided, only one of which is shown at 26, and being mounted for rotation about vertical axes by way of suitable bearings as at 28 within a lower inner casing 30, the screws rotating within suitable bores, as at 31 for helical screw 26. Suction gas is provided to the intermeshed helical screws by way of a compressor suction conduit 32 which opens at its radially inboard end to the bore 31 of the helical screw 26 at its suction side, that is, adjacent the upper end of the intermeshed helical screws. The conduit 32 extends to the outer casing 24 and is directly connected to the end of the suction manifold 16. The compressed gas discharges at the lower end of the intermeshed screws at a discharge port 33 which opens to transverse discharge passage 36. Discharge passage 36 is continued by way of vertical passage 38 and opens to a cavity 40 within upper casing 42 within which is mounted the electric drive motor 22. The motor 22 may constitute an induction motor and comprises a stator 44 and rotor 46. Rotor 46 is mounted for rotation about a vertical axis on shaft 48 via bearings 28 which also mounts the helical screw 26. In that regard, shaft 48 extends to the helical screw 26 and supports the same for rotation by way of bearing 28. Additional bearings may be provided at the lower end of the screw 26.

The compressed gas at discharge pressure escapes to the interior of the casing 24 through vertical passages 50 within rotor 46, as well as within the space between rotor 46 and stator 44 and some of the oil carried thereby is separated from the discharge gas by way of centrifugal force. The gas in discharging from the upper end of the passages 50 impacts against a deflector plate 52 with additional oil separating from the gas, accumulating on this plate and dripping off its periphery. Thus the plate 52 acts as a second means for separating the oil from the discharge gas. The working fluid or gas for the distribution system may comprise air or a suitable refrigerant such as freon or the like, depending upon the system use. The casing 24 is completed at its upper end by a cover or end plate **24*a* which not only supports the deflector plate 52, but is provided with a boss 53 defining a casing discharge port 54 at the center of the casing and being directly connected to the discharge manifold 18. The casing section 42 may be provided with one or more radial openings 55 at the lower end of the motor 22 for permitting oil O, which is separated at the motor unit 22, to flow downwardly to the bottom of the casing 24 for accumulation within the bottom portion of that casing acting as an oil sump. The normal level L of accumulated oil is below the suction conduit 32 and well below the drive motor 22. Discharge manifold 18 carries check valve 64 and shut off valve 66 downstream of port 54**.

With respect to the hermetic compressor unit 14, its structure is identical to that of unit 12 and elements thereof are provided with prime numerical designations. In that respect, the suction conduit 32' of unit 14 is connected to the suction manifold 16 through a suction manifold branch pipe or conduit **16*a*. Likewise, the compressor casing discharge port 54' of unit 14 defined by boss 53' is connected to the discharge manifold by discharge manifold branch pipe or conduit 18*a*. Branch pipe 18*a* bears a check valve 64' and a shut off valve 66' corresponding to those of unit 12 as at 64 and 66**, respectively.

The present invention is directed to a simplified but highly effective arrangement for insuring that the oil is equally distributed between compressors regardless of the idiosyncrasies and characteristics of the compressors or the distribution system. In that regard, it should be realized that the interior of the unit casing 24 for unit 12 and 24' for unit 14 are at compressor discharge pressure and that further, because of the deflector plates 52 and 52' for units 12 and 14 as well as the presence of the check valves 64 and 64' for units 12 and 14 and shut off or control valves 66 and 66' for respective units, as well as the normal resistance to the flow of the compressed gas within the distribution system piping, the discharge pressure within the discharge manifold 18, particularly at points downstream of the hermetic compressor units themselves, is somewhat lower than that appearing within the interior of the casing above the levels L and L' of the oil O accumulating within the sumps of each of the compressor units.

Thus, the present invention advantageously employs this small pressure differential to effect a positive flow of excess oil above levels L and L' for each of the respective compressor units 12 and 14 to the discharge manifold for recirculation within the distribution system to those compressors having a reduced supply of oil and reduced accumulation of oil within its sump. In that respect, the compressor casing 24 is provided with a small, oil bleed port 56 which defines the level L of accumulated oil within the sump portion of that unit, the port 56 being connected to the discharge manifold 18 by an oil line 58 which opens to the discharge manifold at a point 62 downstream of the control valve 66 within that manifold. The oil line 58 is relatively small in diameter and may constitute a half inch or quarter inch pipe or tube. The oil bleed line 58 bears a control valve as at 60 permitting shut off of that line and, downstream thereof, a check valve 61. Likewise, casing 24' is provided with an oil bleed port 56' at an equivalent vertical height to that of bleed port 56 of unit 12 and this port 56' is connected to the discharge manifold 18 at point 62' by way of an oil bleed line 58' which is provided with a manual control valve or shut off valve 60' adjacent to the port 56 and downstream thereof, with a check valve 61' in similar fashion to the hermetic unit 12.

In operation, therefore, due to the presence of the oil bleed ports 56, oil can accumulate only to the extent of oil levels L for unit 12 and L' for unit 14. Otherwise, the discharge pressure within the casing 24 and 24' being slightly above that of the discharge manifold 18, causes the oil to flow through the small diameter oil bleed lines 58 and 58' to the discharge manifold at points downstream from the connections of that manifold to respective compressor units.

Assuming, for instance, that excess oil is tending to accumulate within compressor unit 12, the rise of oil above level L causes the oil to flow radially outward through port 56 within the casing 24 and enter the oil bleed line 56 where due to the pressure differential existing between the discharge manifold 18 and the interior of the casing 24, oil will flow through check valve 61 and enter the discharge stream for distribution with the gas by way of the discharge manifold 18. With the oil level L' within unit 14 at or slightly below the vertical level of bleed port 56' of casing 24', obviously, no oil will be bled from unit 14 and provided to the discharge manifold for redistribution to the other compressor units, except of course, the compressor units may be contributing oil in terms of the small portion of oil which continues to flow with the discharge gas. The system is provided with the oil separation means to effectively eliminate most, if not all, of the oil from the discharge gas. Oil will be provided, however, to the system for redistribution by way of the oil bleed lines 58 and 58' etc. The presence of check valves 61 and 61' prevents discharge gas from flowing back to the compressor units through the oil bleed lines 58 and 58' respectively. Further, the check valves 64 and 64' prevent the gas (and oil) from seeking the interior of the hermetic unit after discharge into the common discharge manifold. The shut off valves 66 and 66' may be employed for shutting off individual compressors from the system as desired.

From the above, it is evident that in a water cooled system/air cooled system for refrigeration or a simple multiple helical screw compressor system could operate without a check valve since the oil pressure in the sump area is that at discharge pressure of the compressor and the oil separation means including the centrifugal action, mechanical deflectors or the like as well as the conduits themselves tend to reduce the pressure of the discharge gas such that there is a small pressure differential tending to force excessive accumulation of oil to flow through the small diameter pipes to the much larger piping of the discharge manifold. A quarter inch or half inch pipe is all that is necessary, depending upon the amount of oil that should be bled as a result of pressure differential upon the accumulation of excessive oil within one compressor unit.

While the invention has been particularly shown and described with reference to a preferred embodiment thereof, it will be understood by those skilled in the art that various changes in form and details may be made therein without departing from the spirit and scope of the invention.

What is claimed is:

1. A compressed gas distribution system comprising; a plurality of hermetic, helical screw rotary compressors compressor units, said compressor units including a hermetic casing defining a sump for the accumulation of oil, intermeshed helical rotary screws and a compressor inlet and outlet, said gas distribution system further comprising a suction manifold and a discharge manifold, means for connecting the suction manifold to the compressor inlets of respective compressors, the compressor outlets opening to the interior of the compressor unit casing such that the lower portion of each casing defines a sump for the accumulation of oil within the casing interior at compressor discharge pressure, each casing being provided with an outlet port well above the level of accumulated oil and opening to the discharge manifold such that the compressor units are connected in parallel, the improvement comprising; an oil bleed port within each casing at the normal level of accumulated oil and a small diameter oil bleed line connecting the oil bleed port to the discharge manifold at a point downstream of the hermetic compressor casing outlet port connection to the discharge manifold for respective compressor units whereby, the compressor discharge pressure within the casings causes excessive oil accumulating within a given casing to flow through the small diameter oil line of that compressor casing to the discharge manifold for redistribution to the remaining compressors to equalize the amount of oil within each compressor unit.

2. The compressed gas distribution system as claimed in claim 1 further comprising check valves within the discharge manifold between the outlet port of the compressor unit casing and the connection point between the oil line and said discharge manifold.

3. The compressed gas distribution system as claimed in claim 2 further comprising a check valve within each oil line between the oil bleed port and the connection of the oil line to the discharge manifold for prevention of return flow of discharge gas and/or oil to the hermetic pressure unit casing from said common discharge manifold.

4. The compressed gas distribution system as claimed in claim 1 further comprising a check valve within each oil line between the oil bleed port and the connection of the oil line to the discharge manifold for prevention of return flow of discharge gas and/or oil to the hermetic pressure unit casing from said common discharge manifold.

* * * * *